US012722872B1

(12) United States Patent
Chang et al.

(10) Patent No.: US 12,722,872 B1
(45) Date of Patent: Sep. 1, 2026

(54) FACIAL TISSUE BOX WITH ADJUSTABLE HEIGHT

(71) Applicants: Keun-Ho Chang, Daejeon (KR); Kevin Chang, Fullerton, CA (US)

(72) Inventors: Keun-Ho Chang, Daejeon (KR); Kevin Chang, Fullerton, CA (US)

( * ) Notice: Subject to any disclaimer, the term of this patent is extended or adjusted under 35 U.S.C. 154(b) by 0 days.

(21) Appl. No.: 19/401,382

(22) Filed: Nov. 26, 2025

(51) Int. Cl.

| | |
|---|---|
| ***B65D 83/08*** | (2006.01) |
| ***A47K 10/20*** | (2006.01) |
| ***B65D 5/02*** | (2006.01) |
| ***B65D 5/36*** | (2006.01) |
| ***B65D 5/42*** | (2006.01) |
| ***B65D 25/56*** | (2006.01) |

(52) U.S. Cl.
CPC ..... *B65D 83/0835* (2013.01); *A47K 10/20* (2013.01); *B65D 5/0236* (2013.01); *B65D 5/3635* (2013.01); *B65D 5/4204* (2013.01); *B65D 5/4266* (2013.01); *B65D 25/56* (2013.01)

(58) Field of Classification Search
CPC .. B65D 5/0236; B65D 5/3635; B65D 5/4266; B65D 25/26; B65D 83/0835; B65D 5/4204; A47K 10/20
USPC ..... 206/233, 494; 221/1, 36, 56, 58, 65, 221/199; 229/101, 101.1
See application file for complete search history.

(56) References Cited

U.S. PATENT DOCUMENTS

| | | | | |
|---|---|---|---|---|
| 4,017,002 | A * | 4/1977 | Doyle | A47K 10/3818 D7/511 |
| 4,616,767 | A * | 10/1986 | Seido | A47K 10/421 221/65 |
| 5,390,820 | A * | 2/1995 | Wright | B65D 83/0811 221/56 |
| 11,939,138 | B1 * | 3/2024 | Chang | B65D 5/3635 |
| 2005/0211755 | A1 * | 9/2005 | Peng | B65D 5/0236 428/41.8 |
| 2007/0175789 | A1 * | 8/2007 | Ronnberg | B65D 85/07 206/494 |
| 2008/0035663 | A1 * | 2/2008 | Byl | B65D 83/0805 221/63 |
| 2008/0272016 | A1 * | 11/2008 | Anderson | B65D 83/0894 206/233 |

* cited by examiner

*Primary Examiner* — Luan K Bui
(74) *Attorney, Agent, or Firm* — AGK Patent & Trademark Law; Philip Y Kim

(57) ABSTRACT

A facial tissue box is designed to enhance first-sheet withdrawal and enable height reduction when tissue levels are low. The box features horizontal fold lines on the front and rear panels, tear lines on the sides and bottom, and a top surface with a tissue outlet formed by intersecting horizontal and vertical slits. When the designated tear lines are cut and the lower side panels are removed, the front and rear panels fold inward along the fold lines to create a new bottom, effectively shortening the box. This structure makes it easier to access the remaining tissues. Additionally, an optional inspection window lets users visually check how many tissues are left.

16 Claims, 6 Drawing Sheets

FACIAL TISSUE BOX WITH ADJUSTABLE HEIGHT

CROSS-REFERENCE TO RELATED APPLICATIONS

This application claims priority to and the benefit of Korean Patent Application No. 10-2025-0156283, filed on Oct. 27, 2025, in the Korean Intellectual Property Office, the entire content of which is incorporated herein by reference.

BACKGROUND OF THE INVENTION

The present invention relates to a facial tissue box. In general, a commonly used facial tissue box is formed of a rectangular cardboard container in which a number of tissues are stacked in an overlapped and folded state. An outlet opening is formed at the center of the upper surface of the tissue box, through which a single sheet of tissue is pulled out. When the user pulls one sheet through the outlet, the next sheet, which is partially overlapped with the withdrawn sheet, is simultaneously drawn up and exposed through the outlet. Thus, the user can continuously and easily withdraw tissues one after another.

However, such a conventional structure has a drawback in that it is rather troublesome to pull out the first sheet of tissue when first using the box. When the user inserts fingers into the outlet to grasp the first tissue, typically three or four sheets are caught together and come out in a lump.

Furthermore, when the remaining tissues in the box are reduced to less than half, it becomes difficult to continuously withdraw tissues through the outlet. The tissue being pulled out may fail to drag the following tissue along, causing the next tissue to remain inside the box instead of being partially exposed through the outlet. This problem occurs because, as the amount of tissues decreases, an empty space is formed at the upper part inside the box, thereby increasing the vertical distance between the tissue stack and the outlet opening. In this situation, the user must insert fingers directly into the outlet to grasp and remove the next tissue, which is inconvenient.

To address this issue, some conventional designs have attempted to reduce the internal height of the tissue box by raising the central bottom portion of the box. However, such approaches keep the overall outer dimensions of the box unchanged and require the bottom center to be pushed upward, resulting in a complex internal structure that is difficult to manufacture and cumbersome to operate.

In response to this, the present applicant previously patented U.S. Pat. No. 11,939,138 B1, dated Mar. 26, 2024, entitled "Height-Adjustable Facial Tissue Box." The registered patent reduces the height of the box by folding the front, rear, left, and right side walls downward and fixing them with locking keys formed on the bottom surface of the box. However, the prior patent involved a tedious process of inserting and locking the folded side walls into the bottom locking keys. In addition, four layers of relatively thick cardboard overlapped at the bottom, resulting in an excessively thick and aesthetically undesirable product.

SUMMARY OF THE INVENTION

The present invention addresses the above and other needs by providing an improved outlet structure that allows the first sheet of tissue to be stably withdrawn without multiple sheets being pulled together or torn when the box is first used. Another object of the invention is to provide an improved height-adjustable facial tissue box that can be easily and quickly reduced in height when the remaining tissues are reduced to less than half, thereby allowing the user to conveniently withdraw the remaining tissues.

To achieve the above objects, a facial tissue box according to the present invention is a rectangular box having an outlet opening on its top surface, wherein horizontal fold lines are formed on both the front and rear panels at the same height, and horizontal tear lines extending from the fold lines are respectively formed on the left and right side panels. From both ends of the horizontal fold lines of the front and rear panels, vertical tear lines extend downward along the edges toward the bottom surface. The bottom surface is formed with a bottom horizontal tear line and vertical tear lines extending along the corners where the left and right side panels meet.

When the bottom horizontal and vertical tear lines are torn, and then the vertical tear lines on the side panels are cut, followed by cutting the horizontal tear lines, the lower portions of the left and right side panels are removed. Thereafter, the front and rear panels are folded inward along their horizontal fold lines to overlap each other, thereby forming a new bottom surface and reducing the overall height of the tissue box.

The newly formed bottom surface, created by folding the front and rear panels inward, is secured in place with adhesive tape attached to the left and right-side panels, so that the box maintains its bottom shape.

The adhesive tape is preferably positioned between the bottom surface of the tissue box and the stack of tissues during manufacture. When the box is turned upside down and the bottom horizontal and vertical tear lines are cut, the tape becomes exposed at the uppermost position inside the box, allowing it to be immediately accessible for use.

Furthermore, the tissue outlet on the top surface includes a transverse slit formed in the horizontal direction, and a single vertical slit extending upward from the central portion of the transverse slit, so that the two slits together form a "⊥"-shaped configuration. The vertical slit is oriented in the same direction as the overlapping direction of the uppermost tissue sheet in the stack.

The tissue outlet is preferably made of a transparent material that covers the "⊥"-shaped slits, and the lengths of the transverse and vertical slits are designed as follows:

$$\text{Length of transverse slit} \fallingdotseq L/2$$

$$\text{Length of vertical slit} \fallingdotseq 3/4 \times f/2$$

Here, L denotes the width of the top surface of the tissue box, and f denotes the depth (length) of the top surface.

In addition, the horizontal fold lines formed on the front and rear panels are located at a height equal to or less than one-half of the total height of the box. The widths and lengths of the front, rear, left, right, and bottom panels satisfy the following mathematical relationship:

$$e = a + c$$

$$a > e/2$$

$$b = f/2$$

$$d = a$$

Here, "e" represents the height of the front and rear panels; "a" represents the height of the upper portion of the side panels connected to the top surface; "c" represents the height of the lower portion of the side panels connected to the bottom surface; "b" represents the width of the folded side sections; "f" represents the depth of the top and bottom surfaces; and "d" represents the height from the bottom surface to the horizontal fold line on the front and rear panels.

Moreover, an observation window including a detachable cut-out portion is provided above the horizontal fold line on at least one of the front or rear panels, so that when the detachable portion is removed, the user can check the remaining amount of tissues inside the box. A transparent film is preferably attached to the inner surface of the detachable cut-out portion.

According to the present invention, since the outlet slit is formed in a "⊥"-shaped configuration, with the vertical slit oriented in the same direction as the overlapping direction of the uppermost tissue sheet, the user's fingertip inserted into the slit directly contacts the edge of the top tissue. This allows the user to accurately sense and withdraw only the first tissue sheet without tearing or pulling multiple sheets together.

Additionally, when the amount of tissues remaining inside the box is reduced to less than half, the user can easily and quickly lower the overall height of the tissue box by cutting along the tear lines and folding along the fold lines formed at the lower portion of the box. As a result, the remaining tissues can be continuously and conveniently withdrawn.

BRIEF DESCRIPTION OF DRAWINGS

The above and other aspects, features and advantages of the present invention will be more apparent from the following more particular description thereof, presented in conjunction with the following drawings wherein.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to descript a feature's appearance to the human eye or human perception, and not a precise measurement, or typically within 10 percent of a stated value.

Hereinafter, preferred embodiments of the present invention will be described in detail with reference to the accompanying drawings.

Figure 1:
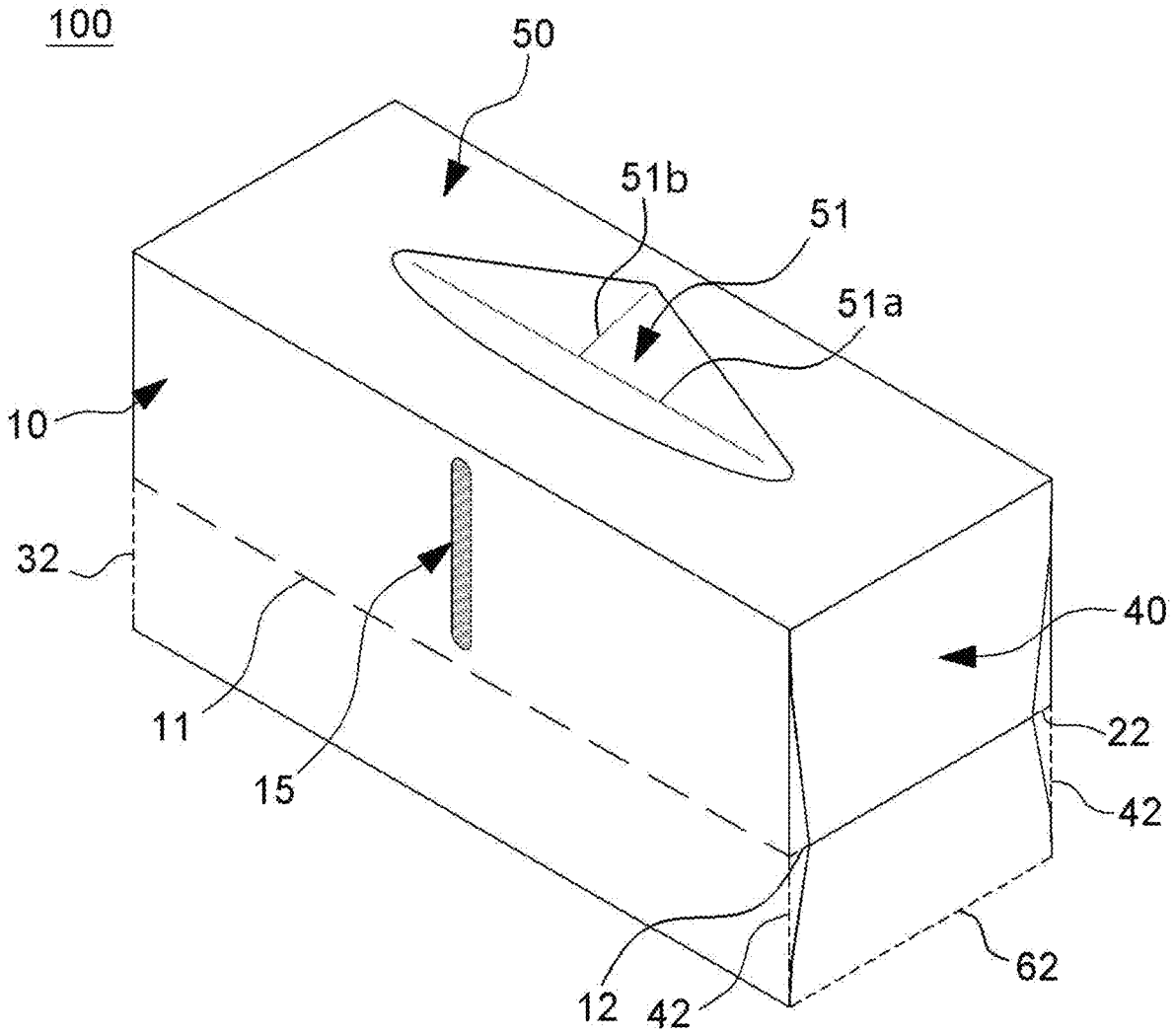
FIG. 1 is a front perspective view of a cosmetic tissue box according to the present invention.
Figure 2:
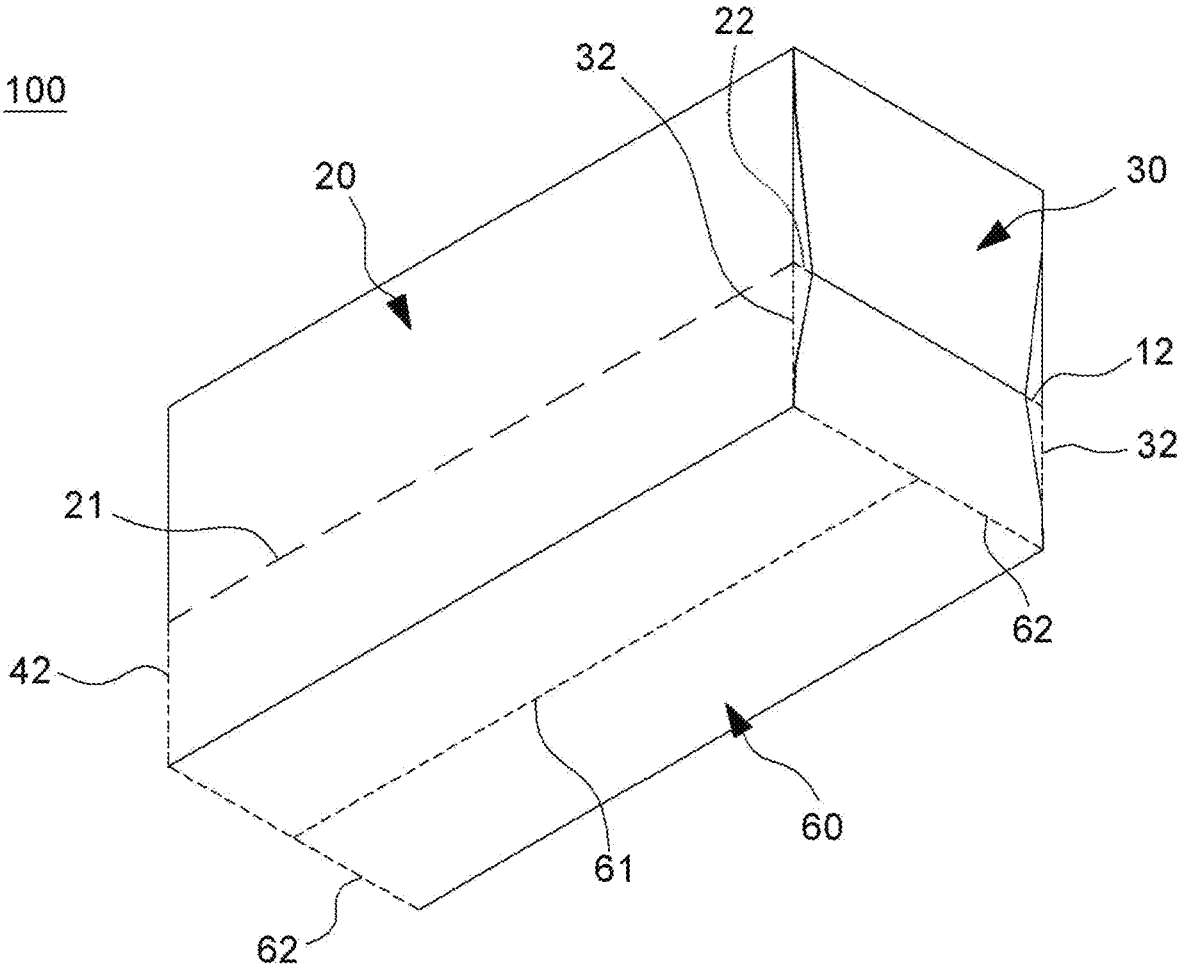
FIG. 2 is a rear perspective view of the cosmetic tissue box according to the present invention.
Figure 3:
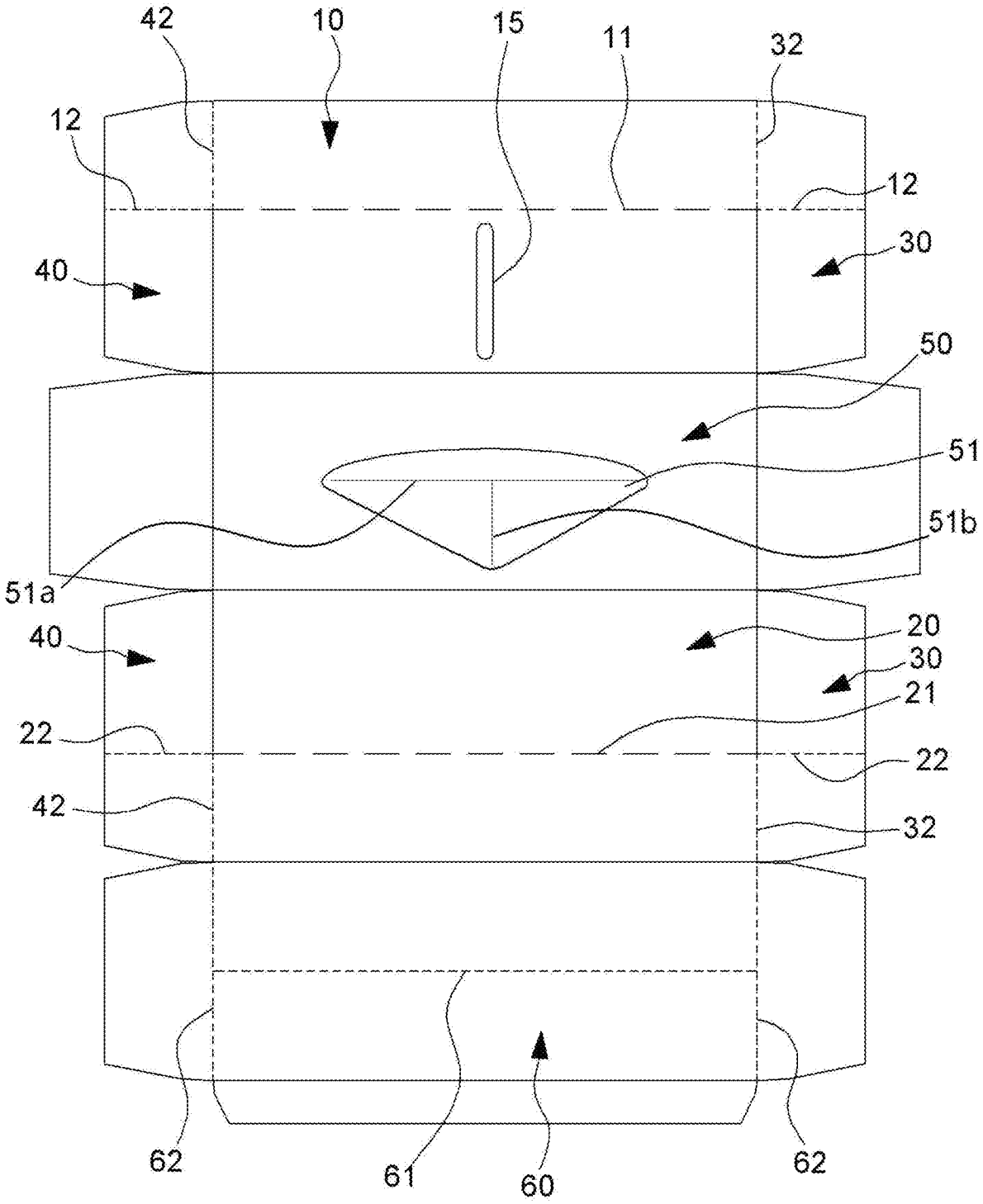
FIG. 3 is an unfolded view of the cosmetic tissue box according to the present invention.

Referring to FIGS. 1 through 3, a cosmetic tissue box 100 according to the present invention has a rectangular parallelepiped shape, similar to conventional tissue boxes. A plurality of tissues is folded and stacked within the interior of the box.

At the center of the upper surface 50 of the tissue box 100, a tissue outlet 51 made of a transparent material is formed. The tissue outlet 51 is provided with a cutting line in the shape of the character "⊥," consisting of a horizontal slit 51*a* and a vertical slit 51*b* that intersect in a "⊥T" configuration. The horizontal slit 51*a* extends laterally, while the vertical slit 51*b* extends perpendicularly from the midpoint of the horizontal slit 51*a*. The direction of the vertical slit 51*b* coincides with the direction in which the uppermost tissue is folded and protrudes, so that when a user inserts a finger into the slit, the fingertip naturally contacts the edge of the topmost tissue. This configuration enables the user to easily grasp and withdraw only the first tissue sheet without tearing or pulling multiple sheets simultaneously.

In this embodiment, the tissue outlet 51 has a rounded triangular shape capable of enclosing the "⊥"-shaped slits 51*a*, 51*b*. Preferably, the horizontal slit 51*a* has a length approximately equal to one-half of the overall lateral length of the tissue box 100, and the vertical slit 51*b* has a length approximately equal to 4/3 of one-half of the vertical length (height) of the box 100.

Horizontal folding lines 11, 21 are formed along the front surface 10 and the rear surface 20 of the tissue box 100 below the mid-height of the box. The left side 30 and right side 40 panels are each provided with horizontal perforation lines 12, 22 that extend from and connect to the folding lines 11, 21 of the front and rear surfaces, respectively. From the ends of the folding lines 11, 21, vertical perforation lines 32, 42 are formed downward along the corners toward the bottom surface 60.

Additionally, at the corners where the left and right side panels meet the bottom surface 60, bottom vertical perforation lines 62 are provided, and a bottom horizontal perforation line 61 extends longitudinally across the center of the bottom surface 60.

In the present invention, the term "folding line" refers to a groove or crease that allows the user to fold the box easily by hand, whereas a "perforation line" refers to a series of small cuts or perforations that enable easy tearing along the designated line.

Above the horizontal folding line 11 on the front surface 10, a tissue inspection window 15 is provided. The inspection window 15 includes a removable perforated section extending vertically. When the perforated section is torn off, the remaining amount of tissue inside the box 100 can be visually checked. In this embodiment, a transparent film, such as vinyl, is attached inside the inspection window 15, thereby preventing direct contact between the tissues and the external environment while allowing the user to visually confirm the tissue quantity inside.

When the tissue supply decreases to half or less—as visible through the inspection window 15—the user can reduce the height of the tissue box 100 by utilizing the folding and perforation lines 11, 21, 12, 22, 32, 42, 61, 62 formed on the front, rear, side, and bottom panels.

Figure 4:
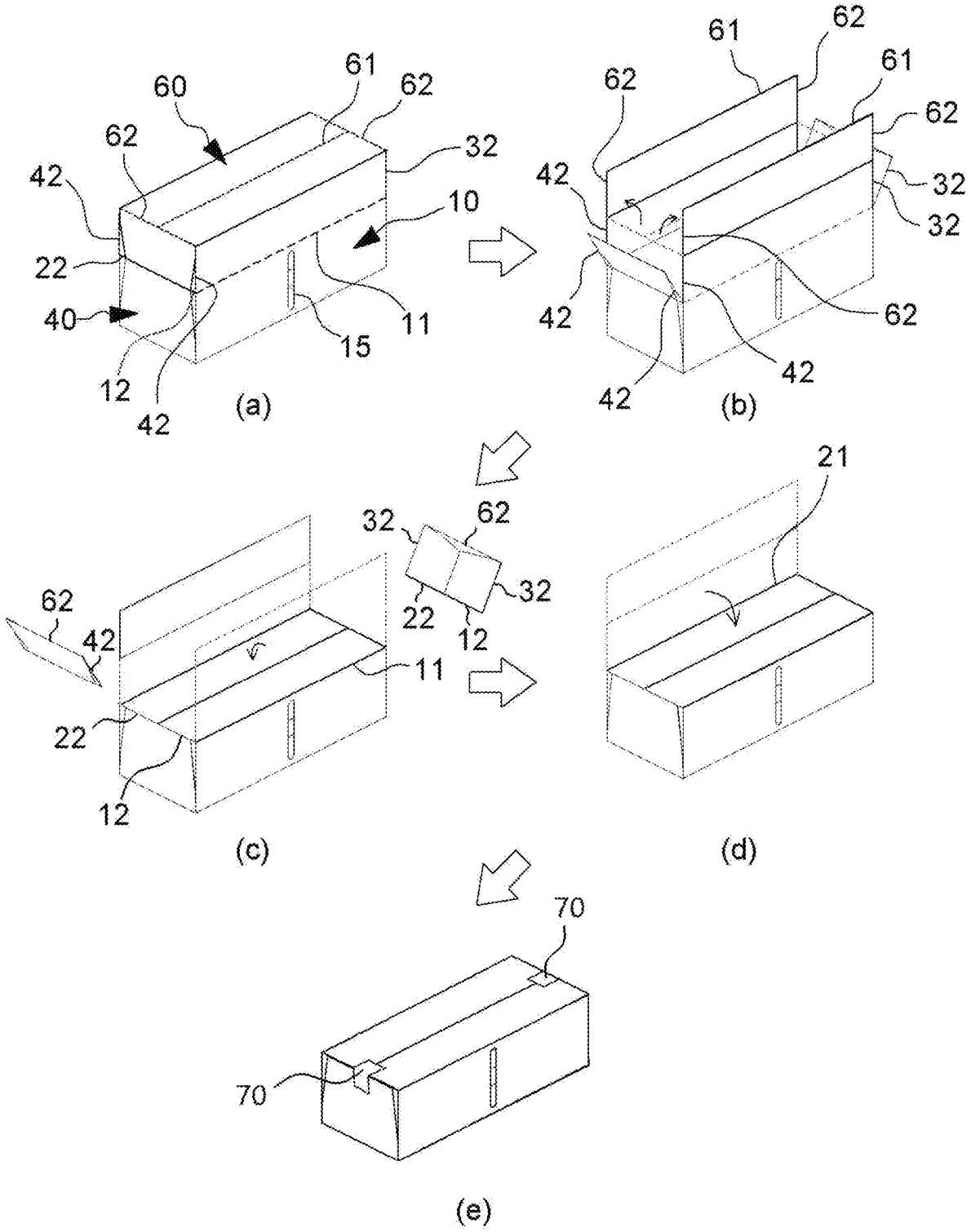
FIG. 4 is a series of views illustrating the process of reducing the height of the cosmetic tissue box according to the present invention.

Referring to FIGS. 4*a-e* and FIG. 5, a method of height reduction process is comprised of the steps of:

As shown in FIG. 4*a*, when the amount of remaining tissues becomes less than half, the box 100 is turned upside down. The remaining tissues settle toward what is now the top surface former bottom surface 60 due to gravity, leaving the upper portion of the interior largely empty.

As shown in FIG. 4*b*, the user presses along the bottom horizontal perforation line 61 to cut it, followed by tearing along the bottom vertical perforation lines 62 and the side vertical perforation lines 32, 42.

As shown in FIG. 4*c*, the user then cuts along the horizontal perforation lines 12, 22 on the left and right-side panels to remove the lower portions of these panels.

As shown in FIG. 4*d*, the front and rear panels 10, 20 are folded inward along the folding lines 11, 21 so that they overlap, thereby forming a new bottom surface.

As shown in FIG. 4*e*, a tape 70 is applied to connect the newly formed bottom surface with the left and right-side panels 30, 40, thereby maintaining structural stability.

In the manufacturing process of the tissue box, the adhesive tape 70—approximately 3 to 5 cm per side—is pre-inserted between the bottom surface 60 and the tissue stack. Thus, when the bottom perforation lines 61, 62 are cut after the box is turned upside down, the tape 70 becomes accessible at the top and can be immediately used to secure the reduced structure.

Figure 5A:
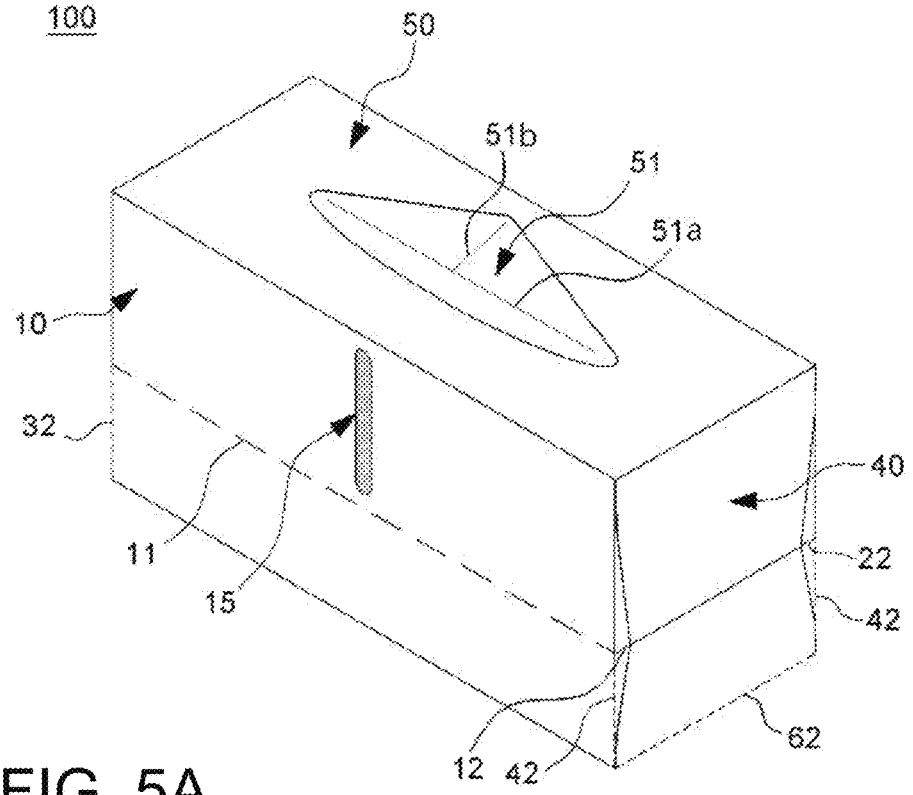
FIGS. 5A and 5B is a perspective view showing the cosmetic tissue box before and after with its height adjusted according to the present invention.
Figure 5B:
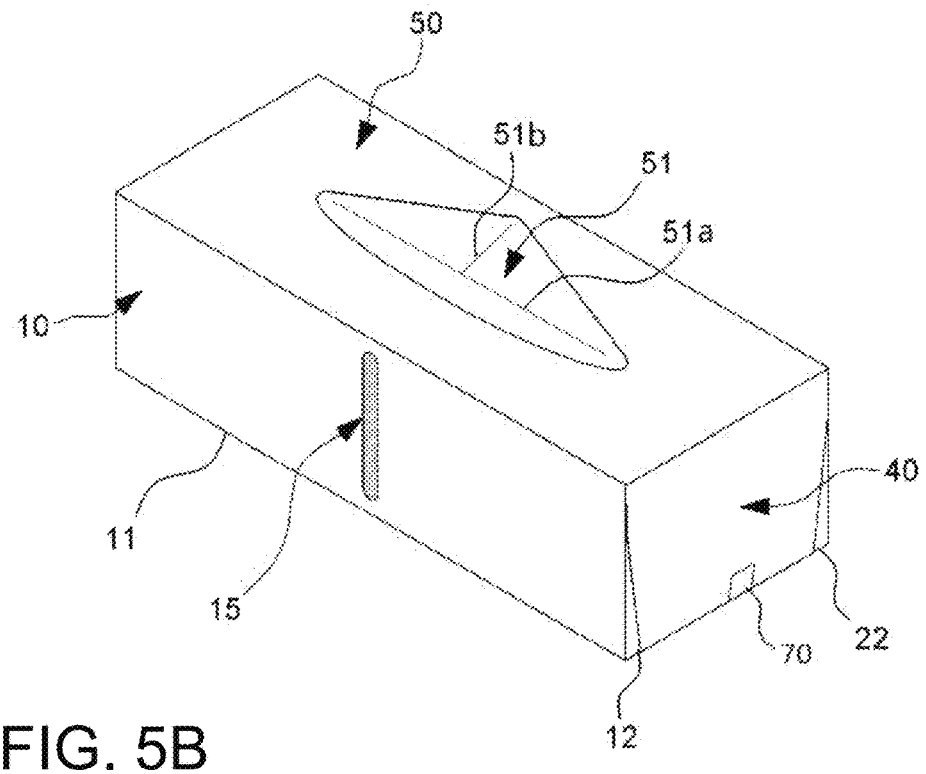

After reassembly, when the box 100 is flipped back to its original orientation, as shown in FIG. 5, it serves as a height-adjusted tissue box.

Figure 6:
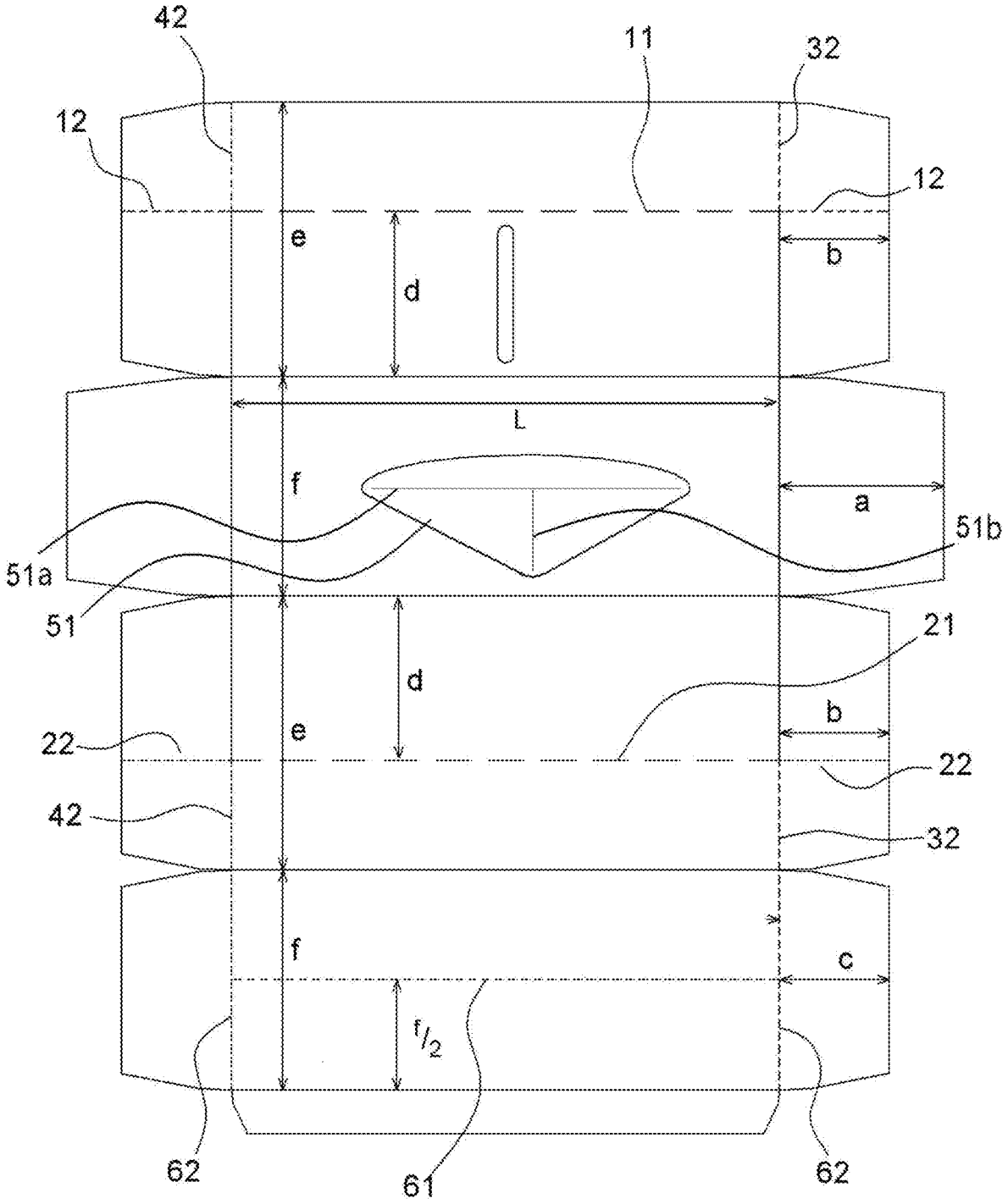
FIG. 6 is an exemplary unfolded view of the cosmetic tissue box with dimensions indicated according to the present invention.

FIG. 6 illustrates an example of the unfolded view of the tissue box 100 with dimensional parameters. The dimensions of the panels are determined so as to satisfy specific mathematical relations that prevent overlap or gaps when the box is reassembled.

According to Equation 1:

e=height of the front and rear panels 10, 20 a=height of the upper folded portion connected to the top surface 50 c=height of the lower folded portion connected to the bottom surface 60, such that e=a+c b=width of the side panel portion connected to the front and rear panels, satisfying b=f/2, where f is the width depth of the top and bottom surfaces d=vertical distance from the top surface 50 to the horizontal folding line 11, 21, and d=a a is slightly greater than one-half of e a>e/2

Furthermore, the length of the horizontal slit 51*a* in the tissue outlet 51 is preferably about one-half of the box length L, and the vertical slit 51*b* is about three-fourths of half the box width ¾×f/2, providing optimal ease of tissue withdrawal.

Through the above configuration, when the remaining tissues fall below half, the user can easily reduce the height of the box by cutting and refolding along the designated perforation and folding lines. This ensures that tissues can continue to be dispensed smoothly until the last sheet, preventing the problem of tissues remaining unpullable at the bottom.

Additionally, by applying the adhesive tape 70 as described, the stability of the newly formed bottom structure is maintained after height reduction.

It will be understood that the present invention is not limited to the embodiments described above and that various modifications and equivalent variations can be made by those skilled in the art without departing from the spirit or scope of the invention as defined in the appended claims.

REFERENCE NUMERALS

100: Cosmetic tissue box
10: Front panel
20: Rear panel
11, 21: Horizontal folding lines
12, 22: Horizontal perforation lines
32, 42: Vertical perforation lines
15: Tissue inspection window
30: Left side panel
40: Right side panel
50: Top surface
51: Tissue outlet
51*a*: Horizontal slit
51*b*: Vertical slit
60: Bottom surface
61: Bottom horizontal perforation line
62: Bottom vertical perforation line
70: Adhesive tape

The invention claimed is:

1. A facial tissue box, comprising:

a rectangular container having a top surface with a tissue outlet, a bottom surface, a front panel, a rear panel, a left side panel, and a right side panel;

horizontal fold lines respectively formed on the front panel and the rear panel at a common height;

horizontal tear lines respectively formed on the left side panel and the right side panel and extending from the horizontal fold lines;

vertical tear lines extending downward from both ends of the horizontal fold lines along corners of the left and right side panels;

a bottom horizontal tear line formed on the bottom surface; and bottom vertical tear lines formed along corners where the left and right side panels meet the bottom surface; and an adhesive tape pre-positioned between the bottom surface and a tissue stack inside the rectangular container during manufacture; and wherein, when the bottom horizontal tear line, the bottom vertical tear lines, the vertical tear lines on the left and right side panels, and the horizontal tear lines are cut, lower portions of the left and right side panels are removable, and the front and rear panels are foldable inward along the horizontal fold lines to overlap and form a newly formed bottom surface to reduce an overall height of the facial tissue box, and the newly formed bottom surface is secured to the left and right side panels by the adhesive tape which becomes exposed when the bottom horizontal tear line and the bottom vertical tear lines are cut, thereby reducing an overall height of the facial tissue box.

2. The facial tissue box of claim 1, further comprising an inspection window located above at least one of the horizontal fold lines on at least one of the front panel or the rear panel, the inspection window having a detachable tear-out portion.

3. The facial tissue box of claim 2, wherein a transparent film is attached to an inner side of the inspection window.

4. The facial tissue box of claim 1, wherein the horizontal fold lines are located at a height equal to or less than one-half of a total height of the facial tissue box.

5. The facial tissue box of claim 1, having dimensional parameters a, b, c, d, and f, wherein "e" is a height of the front and rear panels, "a" is a height of an upper side-panel portion connected to the top surface, "c" is a height of a lower side-panel portion connected to the bottom surface, "b" is a width of a side-panel portion connected to the front and rear panels, "f" is a depth of the top and bottom surfaces, and "d" is a distance from the horizontal fold lines to the top surface.

6. The facial tissue box of claim 5, wherein the dimensional parameters of the panels satisfy the following relationships:

$$e = a + c,$$

$$a > e/2,$$

$$b = f/2, \text{ and}$$

$$d = a.$$

7. The facial tissue box of claim 1, wherein the horizontal tear lines on the left and right side panels are perforation lines configured to facilitate manual cutting without tools.

8. A facial tissue box, comprising:

a rectangular container having a top surface, a bottom surface, a front panel, a rear panel, a left side panel, and a right side panel;

horizontal fold lines respectively formed on the front panel and the rear panel at a common height;

horizontal tear lines respectively formed on the left side panel and the right side panel and extending from the horizontal fold lines;

vertical tear lines extending downward from both ends of the horizontal fold lines along corners of the left and right side panels;

a bottom horizontal tear line formed on the bottom surface; and bottom vertical tear lines formed along corners where the left and right side panels meet the bottom surface; and an adhesive tape pre-positioned between the bottom surface and a tissue stack inside the rectangular container during manufacture; and wherein, when the bottom horizontal tear line, the bottom vertical tear lines, the vertical tear lines on the left and right side panels, and the horizontal tear lines are cut, lower portions of the left and right side panels are removable, and the front and rear panels are foldable inward along the horizontal fold lines to overlap and form a newly formed bottom surface to reduce an overall height of the facial tissue box, and the newly formed bottom surface is secured to the left and right side panels by the adhesive tape which becomes exposed when the bottom horizontal tear line and the bottom vertical tear lines are cut, thereby reducing an overall height of the facial tissue box;

a tissue outlet disposed on the top surface, wherein the tissue outlet comprising an inverted T-Shaped opening defined by a horizontal slit extending laterally across the top surface, and a vertical slit extending perpendicularly upward from a midpoint of the horizontal slit.

9. The facial tissue box of claim 8, wherein the tissue outlet comprises a transparent film covering the inverted T-Shaped opening.

10. The facial tissue box of claim 8, wherein the tissue outlet has a rounded triangular perimeter enclosing the horizontal and vertical slit.

11. The facial tissue box of claim 8, wherein the horizontal slit and the vertical slit are configured such that insertion of a user's fingertip directly engages a top tissue sheet without pulling adjacent sheets simultaneously.

12. The facial tissue box of claim 8, wherein the vertical slit has a length approximately equal to ¾×(f/2), where "f" is a depth of the top surface.

13. The facial tissue box of claim 8, wherein the horizontal slit has a length approximately equal to L/2, where "L" is a width of the top surface.

14. A method of reducing a height of a facial tissue box, the box having a front panel, a rear panel, left and right side panels, a top surface, a tissue stack, and an original bottom surface with designated tear lines, the method comprising:

turning the facial tissue box upside down so that remaining tissues in the tissue stack settle toward the top surface of the box;

cutting a bottom horizontal tear line on the original bottom surface;

cutting bottom vertical tear lines on the original bottom surface along corners where the left and right side panels meet the original bottom surface;

cutting vertical tear lines on the left and right side panels;

cutting horizontal tear lines on the left and right side panels to remove lower portions of the side panels;

folding the front panel and the rear panel inward along horizontal fold lines to overlap and form a newly formed bottom surface; and securing the newly formed bottom surface to the left and right side panels with an adhesive tape that is pre-inserted between the original bottom surface and the tissue stack during manufacture and becomes exposed when the bottom horizontal tear line and the bottom vertical tear lines are cut, thereby reducing the height of the tissue box so that remaining tissues can be more easily dispensed.

15. The method of claim 14, further comprising visually confirming a remaining tissue amount through an inspection window before turning the facial tissue box upside down.

16. The method of claim 14, further comprising re-orienting the box to its original upright orientation after the adhesive tape secures the newly formed bottom surface.

* * * * *